US010799936B2

(12) United States Patent
Murata et al.

(10) Patent No.: US 10,799,936 B2
(45) Date of Patent: Oct. 13, 2020

(54) PRESS-MOLDING SYSTEM AND PRESS-MOLDING METHOD

(71) Applicant: HODEN SEIMITSU KAKO KENKYUSHO CO., LTD., Atsugi-shi, Kanagawa (JP)

(72) Inventors: Chikara Murata, Zama (JP); Atsumori Inada, Atsugi (JP)

(73) Assignee: HODEN SEIMITSU KAKO KENKYUSHO CO., LTD., Atsugi-shi, Kanagawa (JP)

( * ) Notice: Subject to any disclaimer, the term of this patent is extended or adjusted under 35 U.S.C. 154(b) by 750 days.

(21) Appl. No.: 15/450,258

(22) Filed: Mar. 6, 2017

(65) Prior Publication Data

US 2017/0173661 A1 Jun. 22, 2017

Related U.S. Application Data

(63) Continuation of application No. PCT/JP2015/066354, filed on Jun. 5, 2015.

(30) Foreign Application Priority Data

Sep. 25, 2014 (JP) ..... 2014-194660

(51) Int. Cl.
*B21J 9/20* (2006.01)
*B21K 27/00* (2006.01)
(Continued)

(52) U.S. Cl.
CPC ..... *B21J 9/20* (2013.01); *B21K 27/00* (2013.01); *B21K 27/04* (2013.01);
(Continued)

(58) Field of Classification Search
CPC . B21J 9/20; B21K 27/00; B21D 43/00; B21D 43/02; B21D 43/025
(Continued)

(56) References Cited

U.S. PATENT DOCUMENTS 4,339,972 A * 7/1982 Wepner ..... B21K 27/00 33/1 V
5,310,105 A * 5/1994 Mills ..... B21D 43/021 226/118.2
(Continued)

FOREIGN PATENT DOCUMENTS

CN 1663921 A 9/2005
CN 201120493 Y 9/2008
(Continued)

OTHER PUBLICATIONS

Communication dated Feb. 26, 2018, from the State Intellectual Property Office of People's Republic of China in counterpart Application No. 201580051866.8.
(Continued)

*Primary Examiner* — Shelley M Self
*Assistant Examiner* — Smith Oberto Bapthelus
(74) *Attorney, Agent, or Firm* — Sughrue Mion, PLLC

(57) ABSTRACT

A press-molding system 1 includes a press-molding unit 2 having a main body 21, a lower molding die 23 installed at the lower portion of the main body 21, a drive part 24 installed to the main body 21, and an upper molding die 26 installed so as to be vertically movable with respect to the lower molding die 23 by the drive part 24, a workpiece weight measuring unit 5 that measures the weight of a workpiece, and a controller 7 that controls the drive part 24 according to the weight of a workpiece measured by the workpiece weight measuring unit 5.

7 Claims, 7 Drawing Sheets

(51) Int. Cl.
*B21K 27/04* (2006.01)
*B30B 15/26* (2006.01)
*B30B 15/00* (2006.01)

(52) U.S. Cl.
CPC ..... *B30B 15/0041* (2013.01); *B30B 15/0094* (2013.01); *B30B 15/26* (2013.01)

(58) Field of Classification Search
USPC ..... 72/17.3
See application file for complete search history.

(56) References Cited

U.S. PATENT DOCUMENTS 5,317,892 A * 6/1994 Medici ..... B21D 43/025 100/229 R
5,678,446 A * 10/1997 Futamura ..... B21D 22/206 72/404
6,098,435 A * 8/2000 Takada ..... B21D 5/02 72/31.11
7,293,500 B2 * 11/2007 Futamura ..... B30B 1/18 100/230
7,467,534 B2 * 12/2008 Bytow ..... B21D 28/34 72/419
7,574,891 B2 * 8/2009 Futamura ..... B30B 1/18 100/280
9,259,866 B2 * 2/2016 Fujiwara ..... B29C 43/36
9,925,705 B2 * 3/2018 Otsuka ..... B29C 45/36
2004/0011456 A1 * 1/2004 Futamura ..... B21D 35/00 156/256
2010/0041807 A1 * 2/2010 Eiha ..... B29C 31/048 524/401
2010/0104855 A1 * 4/2010 Yoshioka ..... B29B 11/12 428/323
2015/0231845 A1 * 8/2015 Murata ..... H02K 15/02 100/215
2015/0266260 A1 * 9/2015 Fujioka ..... B32B 3/30 428/118
2017/0129010 A1 * 5/2017 Murata ..... B22F 3/105
2017/0129011 A1 * 5/2017 Murata ..... B22F 3/1055
2017/0173661 A1 * 6/2017 Murata ..... B21K 27/00

FOREIGN PATENT DOCUMENTS

CN 101370603 A 2/2009
CN 102652978 A 9/2012
DE 102004012858 A1 10/2005
JP 04-066241 A 3/1992
JP 06-335745 A 12/1994
JP 09-248713 A 9/1997
JP 11-156472 A 6/1999
JP 2001-58239 A 3/2001
JP 2005-081385 * 1/2005
JP 2005-34851 A 2/2005
JP 2005-81385 A 3/2005
TW 200626336 A 8/2006
TW 200722272 A 6/2007

OTHER PUBLICATIONS

Communication dated Apr. 2, 2019 from the China National Intellectual Property of Administration in counterpart Application No. 201580051866.8.
Notice of Rejection dated Apr. 24, 2017 from the Taiwanese Patent Office in counterpart Taiwanese application No. 104121151.
Extended European Search Report dated May 4, 2018, from European Patent Office in counterpart application No. 15844042.0.
International Search Report for PCT/JP2015/066354, dated Sep. 1, 2015.
Fourth Notice of Rejection dated Oct. 22, 2019 issued by the China National Intellectual Property of Administration in counterpart Application No. 201580051866.8.

* cited by examiner

PRESS-MOLDING SYSTEM AND PRESS-MOLDING METHOD

CROSS-REFERENCE TO RELATED APPLICATIONS

This application is a continuation claiming priority on the basis of Japan Patent Application No. 2014-194660 applied in Japan on Sep. 25, 2014 and based on PCT/JP2015/066354 filed on Jun. 5, 2015. The contents of both the PCT application and the Japan Application are incorporated herein by reference.

BACKGOUND OF THE INVENTION AND RELATED ART STATEMENT

The present invention relates to a press-molding system and a press-molding method that perform control according to the weight of a workpiece.

A measuring apparatus that measures the weight of billets obtained by cutting a steel bar and supplies only non-defective products to a press-molding machine is known. As an apparatus having such a configuration, there is disclosed a measuring apparatus that measures the length of the billet as well as the weight thereof to thereby prevent a variation in the weight caused due to error of the diameter of the steel bar (see, for example, JP 2005-81385A).

SUMMARY OF INVENTION

The present disclosure relates to a press-molding system which includes: a press-molding unit having a main body, a lower molding die installed at the lower portion of the main body, a drive part installed to the main body, and an upper molding die installed so as to be vertically movable with respect to the lower molding die by the drive part; a workpiece weight measuring unit that measures the weight of a workpiece; and a controller that controls the drive part according to the weight of a workpiece measured by the workpiece weight measuring unit.

The present disclosure relates to a press-molding method which includes the steps of: measuring the weight of a workpiece; determining whether the weight of a workpiece measured falls within a previously stored predetermined value range; and performing press-molding according to the weight of a workpiece when the measured workpiece weight falls within a previously stored predetermined value range.

DESCRIPTION OF EMBODIMENTS

Figure 1:
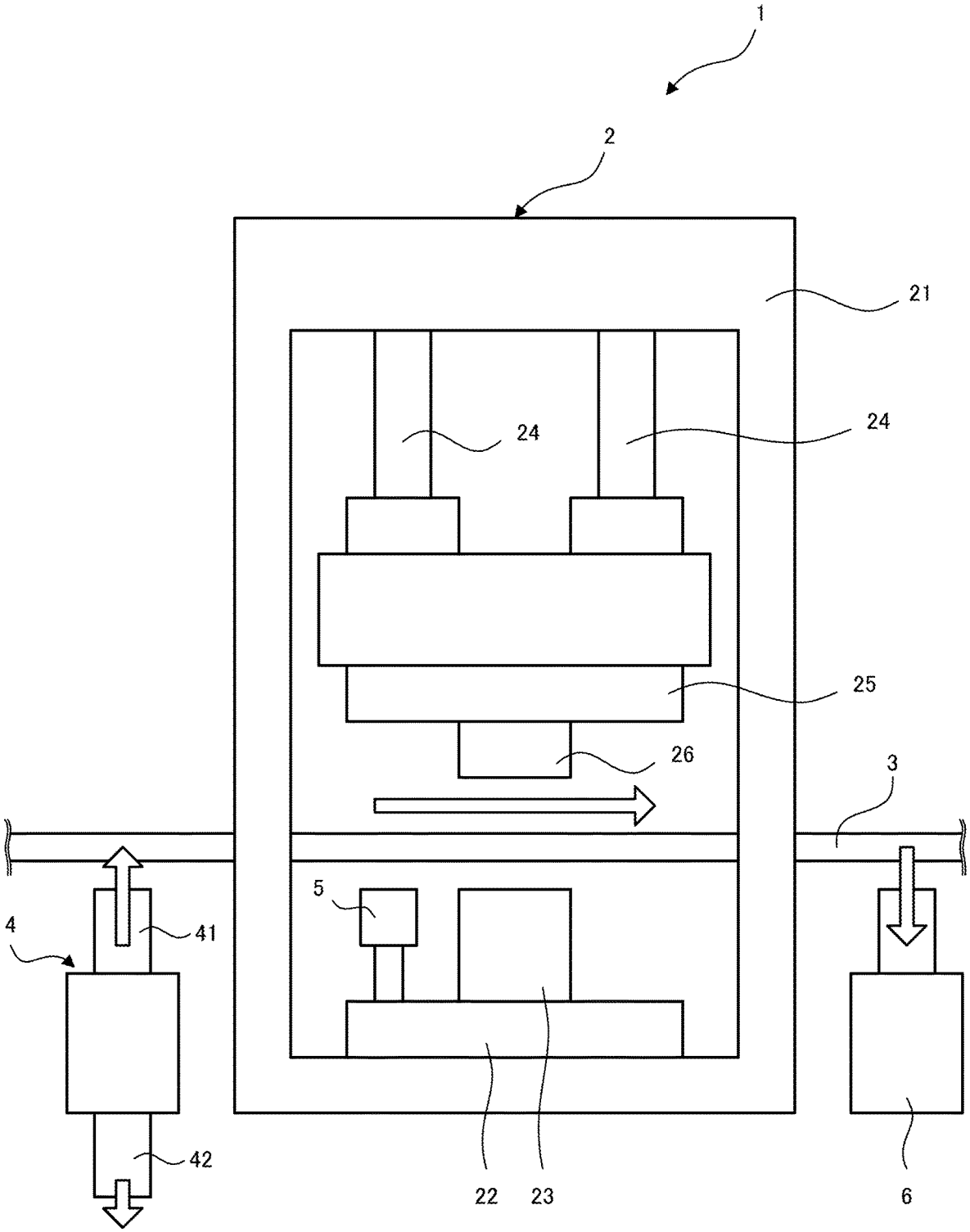
FIG. 1 is a schematic front view illustrating a press-molding system according to an embodiment of the present invention.
Figure 2:
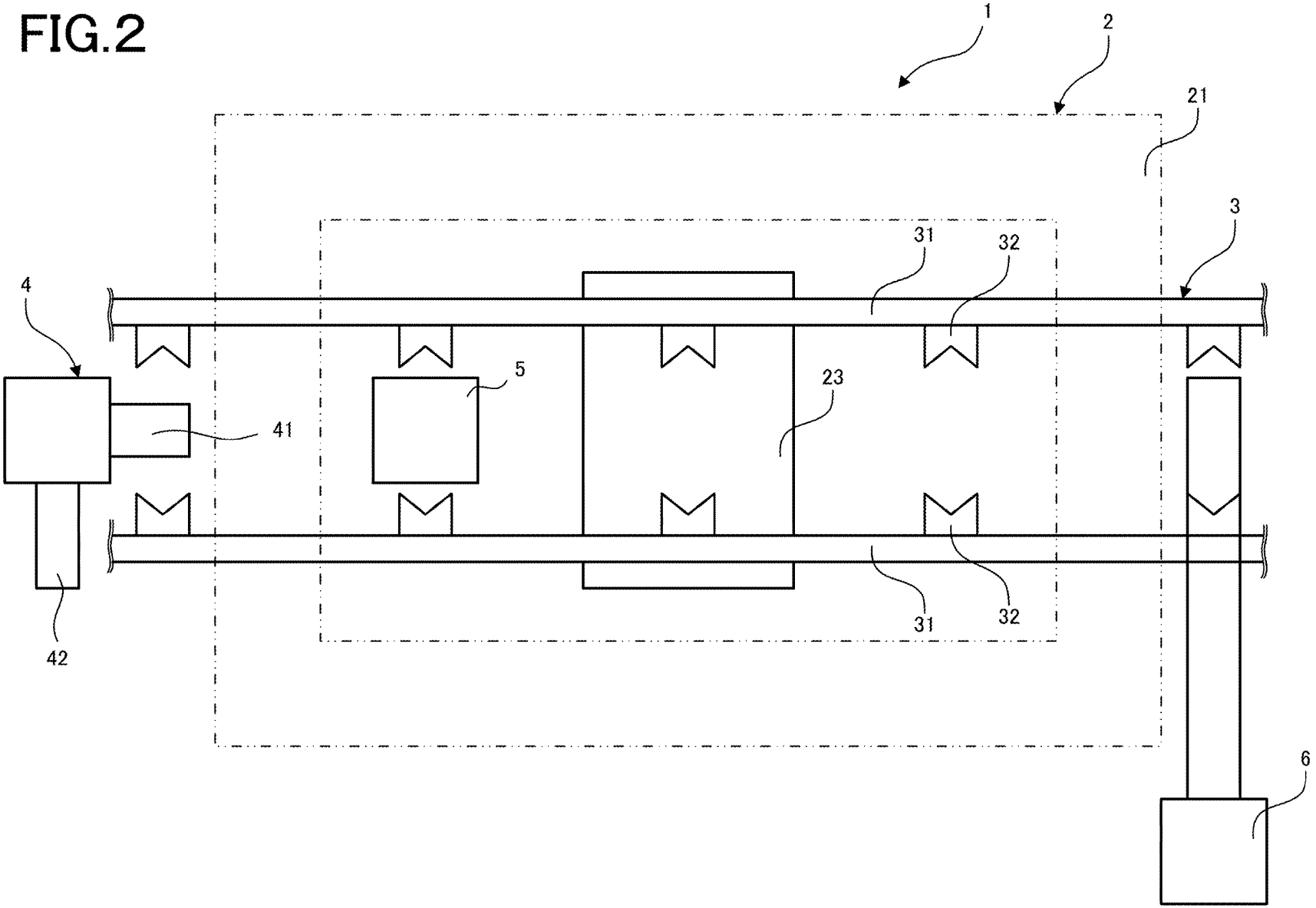
FIG. 2 is a schematic plan view illustrating the press-molding system according to the embodiment of the present invention.

FIG. 1 is a schematic front view illustrating a press-molding system according to an embodiment of the present invention. FIG. 2 is a schematic plan view illustrating the press-molding system according to the embodiment of the present invention.

A press-molding system 1 according to the present embodiment includes a press-molding unit 2, a transfer unit 3, a workpiece supply unit 4, a workpiece weight measuring unit 5, and a finishing unit 6. The above units can each be used alone as one device.

The press-molding unit 2 has a main body 21, a lower die plate 22 installed at the lower portion of the main body 21, a lower molding die 23 installed on the lower die plate 22, a drive part 24 installed at the upper portion of the main body 21, an upper die plate 25 installed so as to be vertically movable with respect to the main body by the drive part 24, and an upper molding die 26 installed under the upper die plate 25. The press-molding unit 2 is preferably configured to perform cold press molding.

The transfer unit 3 conveys a workpiece to the workpiece supply unit 4, workpiece weight measuring unit 5, press-molding unit 2 and finishing unit 6 in order. In the present embodiment, the transfer unit 3 has conveying members 31 and arms 32. The conveying members 31 are installed in parallel over the above-described units, and the arms 32 are provided at predetermined intervals so as to protrude inward. The arms 32 receive a workpiece thereon or hold the same and deliver the workpiece at a predetermined position.

The workpiece supply unit 4 has a supply part 41 that supplies a workpiece to the transfer unit 3 and a discharge part 42 that discharges a nonstandard workpiece. The workpiece supply unit 4 performs sorting of workpieces based on whether the dimension or weight of a workpiece falls within a predetermined value range. When the dimension or weight of a workpiece falls within a predetermined value range, the workpiece is supplied from the supply part 41 to the transfer unit 3. On the other hand, when the dimension or weight of a workpiece falls outside a predetermined value range, the workpiece is discharged from the discharge part 42.

The workpiece weight measuring unit 5 measures the weight of a workpiece. A workpiece is moved from the transfer unit 3 to the workpiece weight measuring unit 5, where the weight thereof is measured. When the weight of the workpiece falls within a predetermined value range, the workpiece is returned from the workpiece weight measuring unit 5 to the transfer unit 3. On the other hand, when the weight of a workpiece falls outside a predetermined value range, it is preferable that the workpiece is not returned to the transfer unit 3 but discharged or that the transfer unit 3 and press-molding machine are stopped. Further, when the weight of a workpiece falls outside a predetermined value range, this is preferably notified to the surroundings by an alarm sound or an alarm display. Further, a pres-molding load is preferably detected based on a drive part torque or a load sensor for prevention of breakage of a die.

The finishing unit 6 finishes a workpiece molded in the press-molding unit 2 and discharged from the transfer unit 3 with high accuracy by removing a burr on the workpiece or polishing the surface thereof.

The following describes a control configuration of the press-molding system according to the present embodiment.

Figure 3:
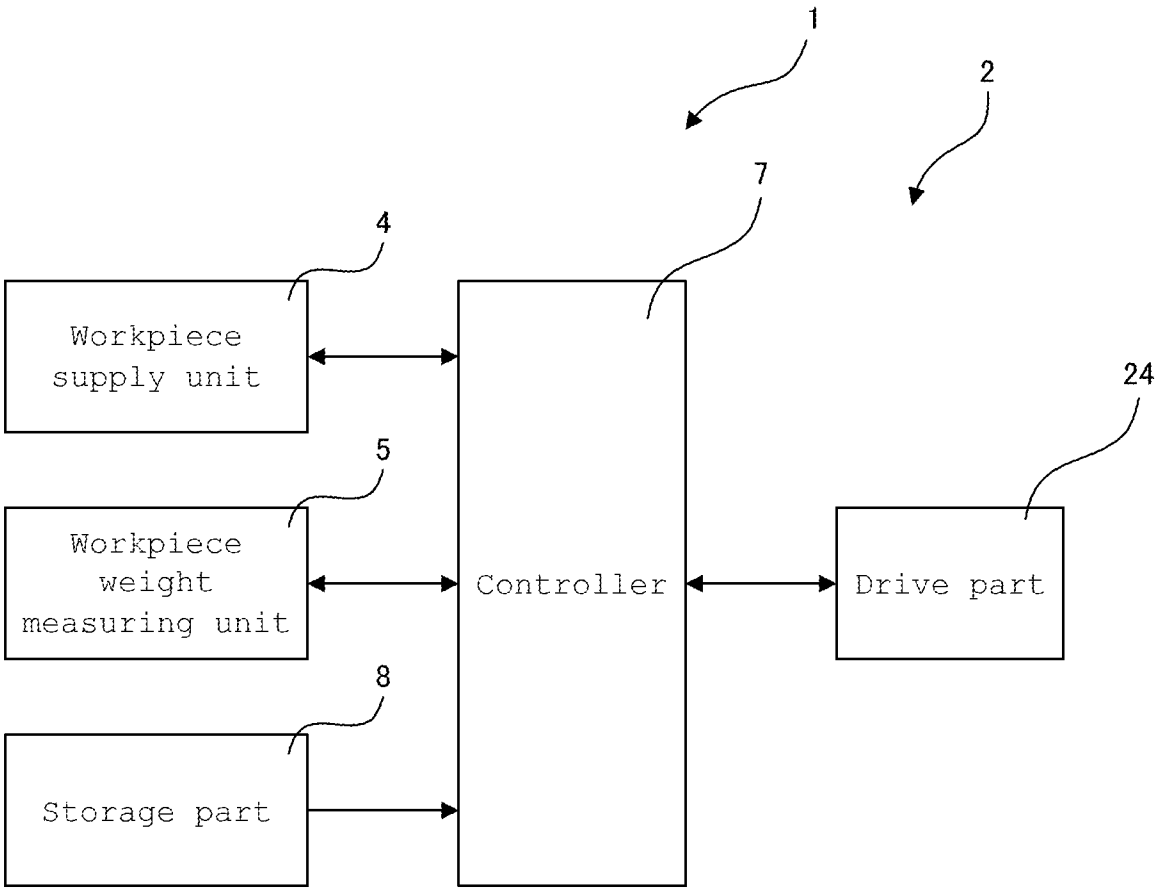
FIG. 3 is a system diagram of the press-molding system according to the embodiment of the present invention.

FIG. 3 is a system diagram of the press-molding system according to the embodiment of the present invention.

In the press-molding system 1, a controller 7 controls the press-molding unit 2 according to a measurement value from the workpiece weight measuring unit 5. For example, the press-molding system 1 according to the present embodiment controls the bottom dead center of the drive part 24 of the press-molding unit 2. Further, the press-molding system 1 according to the present embodiment has a storage part 8 that stores a workpiece weight and the like serving as a criterion of sorting performed in the workpiece supply unit 4 and the workpiece weight measuring unit 5. Thus, the controller 7 controls the drive part 24 of the press-molding unit 2 by comparing the workpiece weight and the like measured in the workpiece supply unit 4 or workpiece weight measuring unit 5 with the workpiece weight and the like as the sorting criterion previously stored in the storage part 8.

The controller 7 can separately control the transfer unit 3, workpiece supply unit 4, workpiece weight measuring unit 5, and finishing unit 6 of the press-molding system 1.

Figure 4:
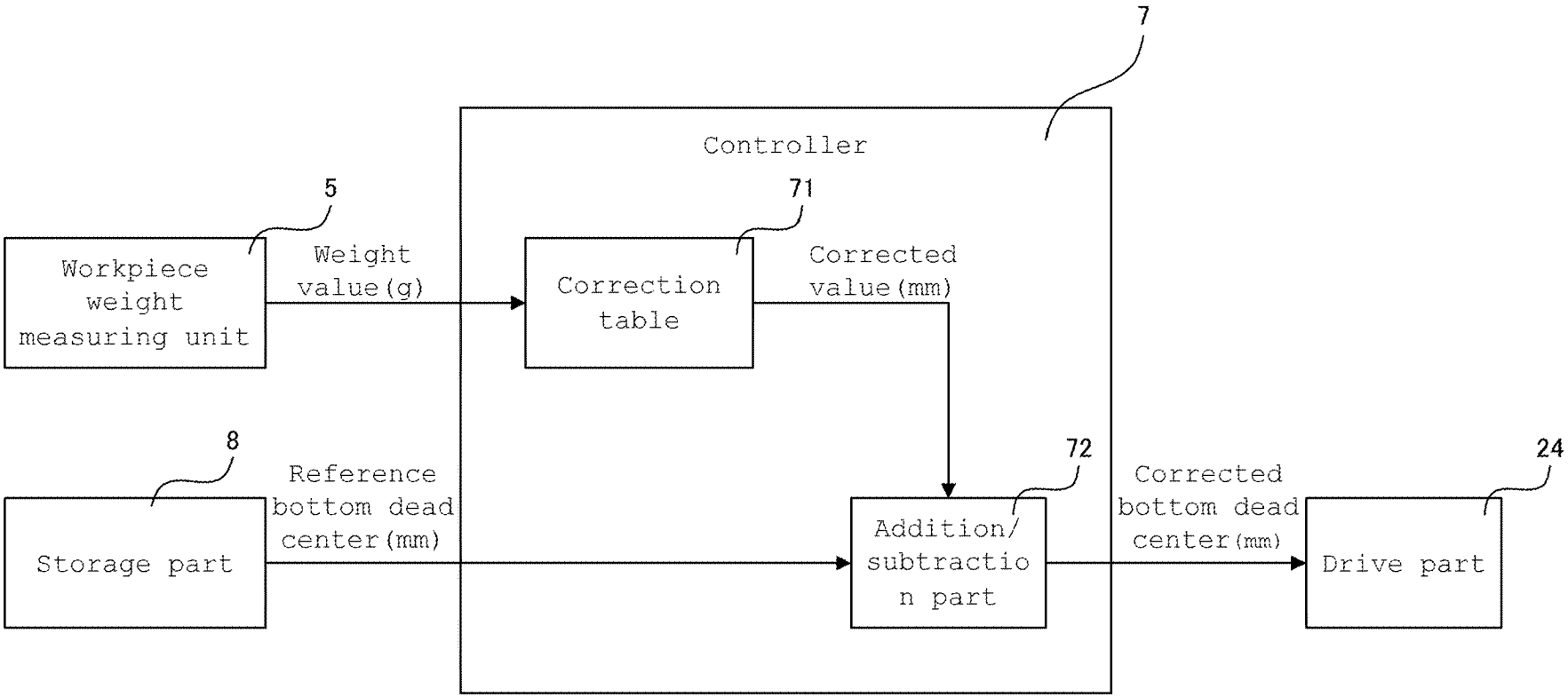
FIG. 4 is a view illustrating a controller of the press-molding system according to the embodiment of the present invention.

FIG. 4 is a view illustrating the controller of the press-molding system according to the embodiment of the present invention.

In the press-molding system 1 according to the present embodiment, the controller 7 controls the drive part 24 to set the position of the bottom dead center of the upper molding die 26. In the example illustrated in FIG. 4, the heights of some finished products with respect to the weights of workpieces are previously measured. Then, the relationship between a workpiece reference height with respect to a workpiece reference weight and a difference between the actual workpiece weight and the reference height is calculated and stored in the storage part 8. Further, a proper bottom dead center of the upper molding die 26 with respect to the workpiece weight is calculated, and the relationship between the proper bottom dead center and the workpiece weight is stored in a correction table 71.

During workpiece machining, the controller 7 refers to the correction table 71 to identify a correction amount with respect to a weight measured by the workpiece weight measuring unit 5. Then, an addition/subtraction part 72 calculates a corrected bottom dead center by adding or subtracting the correction amount identified in the correction table 71 to or from a reference bottom dead center stored in the storage part 8. Based on the calculated corrected bottom dead center, the controller 7 controls the drive part 24. The correction table 71 constitutes a correction part.

Figure 5:
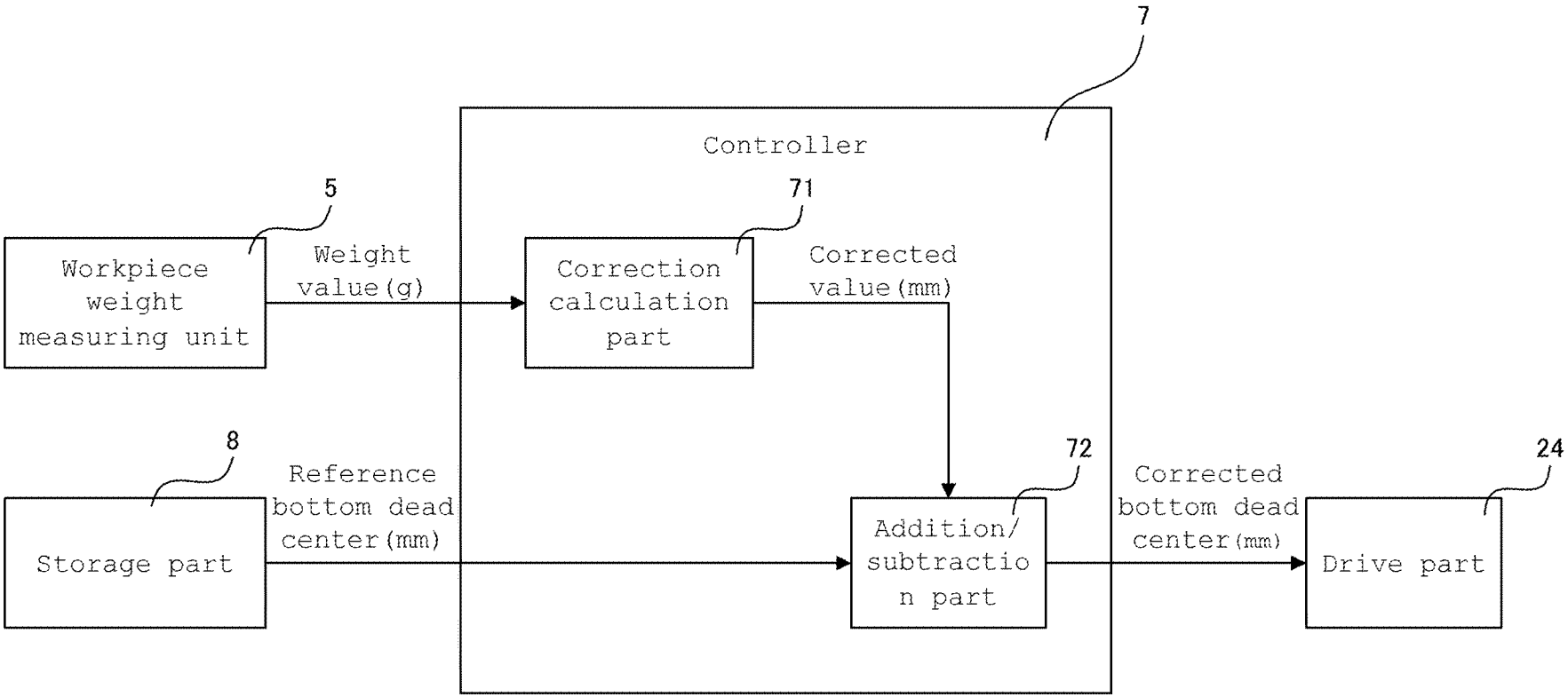
FIG. 5 is a view illustrating the controller of a press-molding system according to another embodiment of the present invention.

FIG. 5 is a view illustrating the controller of a press-molding system according to another embodiment of the present invention.

In the press-molding system 1 according to another embodiment, the controller 7 controls the drive part 24 to set the position of the bottom dead center of the upper molding die 26. In the example illustrated in FIG. 5, the heights of some finished products with respect to the weights of workpieces are previously measured. Then, the relational expression between a workpiece reference height with respect to a workpiece reference weight and a difference between the actual workpiece weight and the reference height is calculated and stored in the storage part 8. Further, a proper bottom dead center of the upper molding die 26 with respect to the workpiece weight is calculated, and the relational expression between the proper bottom dead center and the workpiece weight is stored in a correction calculation part 73.

During workpiece machining, the controller 7 uses the correction calculation part 73 to calculate a correction amount with respect to a weight measured by the workpiece weight measuring unit 5. Then, the addition/subtraction part 72 calculates a corrected bottom dead center by adding or subtracting the correction amount calculated by the correction calculation part 73 to or from a reference bottom dead center stored in the storage part 8. Based on the calculated corrected bottom dead center, the controller 7 controls the drive part 24. The correction calculation part 73 constitutes a correction part.

Figure 6:
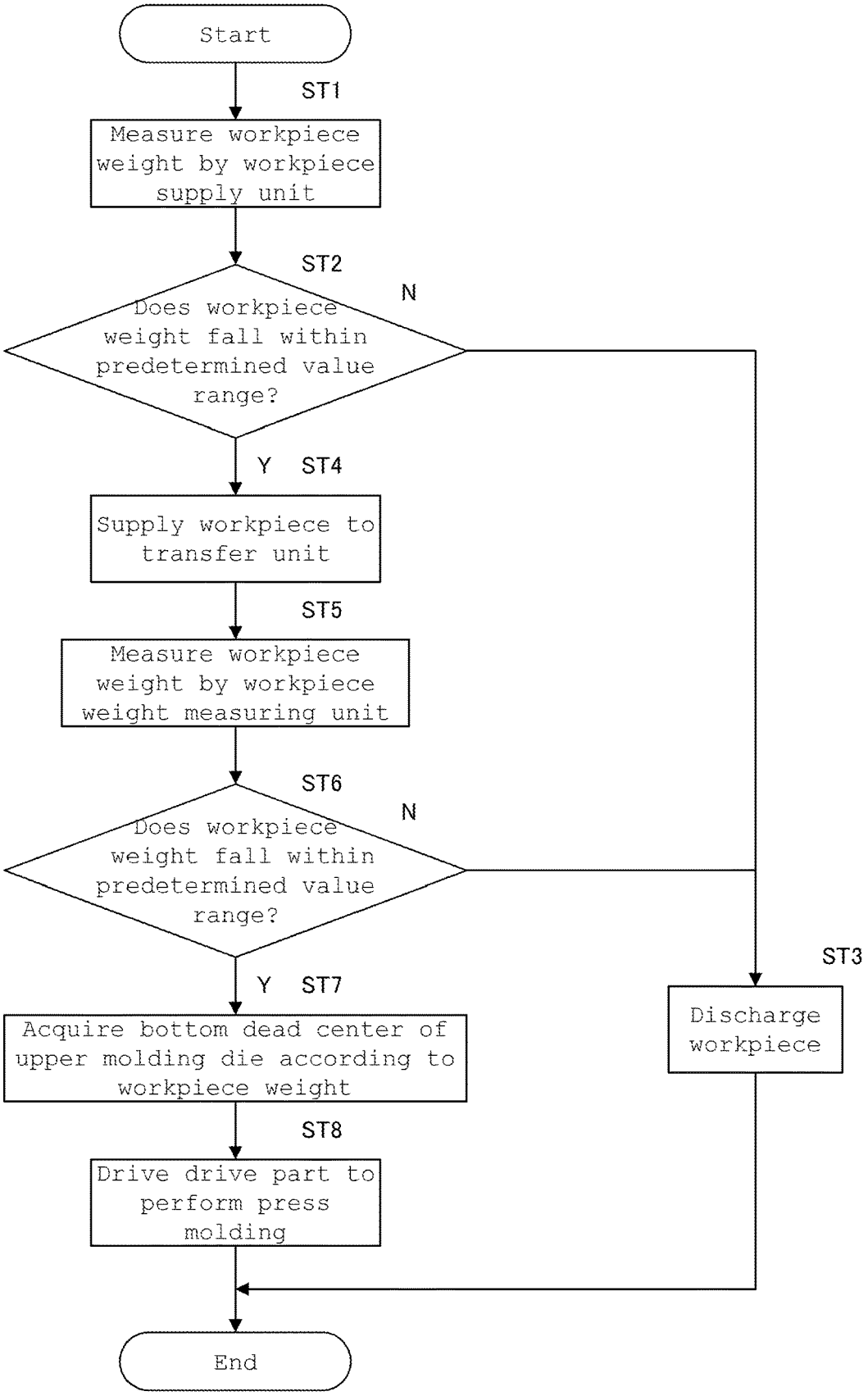
FIG. 6 is a flowchart of the operation of the press-molding system according to an embodiment of the present invention.

FIG. 6 is a flowchart of the operation of the press-molding system according to an embodiment of the present invention.

First, in the press-molding system 1 according to the present embodiment, the workpiece supply unit 4 measures a workpiece in step 1 (ST1). Subsequently, in step 2, the controller 7 determines whether the weight of the workpiece measured by the workpiece supply unit 4 falls within a predetermined value range previously stored in the storage part 8 (ST2). Although the weight of the workpiece is measured in the present embodiment, the determination may be made based on the dimension of the workpiece.

When it is determined in step 2 that the weight of the workpiece measured by the workpiece supply unit 4 falls outside a predetermined value range previously stored in the storage part 8, the workpiece is discharged from the discharge part 42 in step 3 (ST3).

When it is determined in step 2 that the weight of the workpiece measured by the workpiece supply unit 4 falls within a predetermined value range previously stored in the storage part 8, the workpiece is supplied from the supply part 41 to the transfer unit 3 in step 4 (ST4).

Then, in step 5, the weight of the workpiece supplied to the transfer unit 3 is measured by the workpiece weight measuring unit 5 (ST5). Subsequently, in step 6, the controller 7 determines whether the weight of the workpiece measured by the workpiece weight measuring unit 5 falls within a predetermined value range previously stored in the storage part 8 (ST6).

When it is determined in step 6 that the weight of the workpiece measured by the workpiece weight measuring unit 5 falls outside a predetermined value range previously stored in the storage part 8, the workpiece is discharged from the discharge part 42 in step 3 (ST3).

When it is determined in step 6 that the weight of the workpiece measured by the workpiece weight measuring unit 5 falls within a predetermined value range previously stored in the storage part 8, the bottom dead center of the upper molding die 26 corresponding to the weight of the workpiece is identified in step 7 (ST7). Thereafter, in step 8, the drive part 24 is controlled so as to position the upper molding die 26 to the bottom dead center acquired in step 7 and performs press-molding (ST8).

Figure 7:
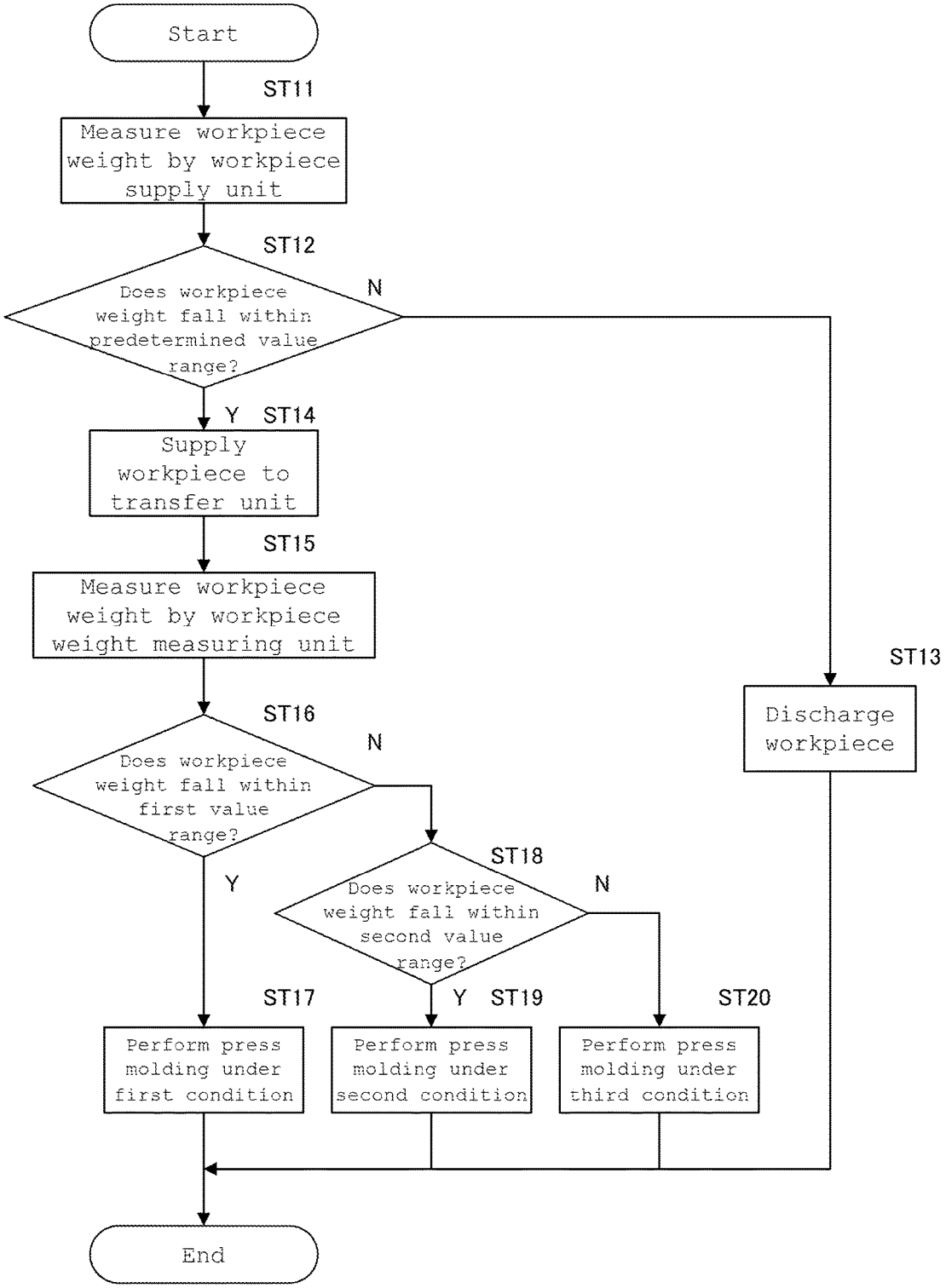
FIG. 7 is a flowchart of the operation of the press-molding system according to another embodiment of the present invention.

FIG. 7 is a flowchart of the operation of the press-molding system according to another embodiment of the present invention.

First, in the press-molding system 1 according to another embodiment, the workpiece supply unit 4 measures a workpiece in step 11 (ST11). Subsequently, in step 12, the controller 7 determines whether the weight of the workpiece measured by the workpiece supply unit 4 falls within a predetermined value range previously stored in the storage part 8 (ST12). Although the weight of the workpiece is measured in the present embodiment, the determination may be made based on the dimension of the workpiece.

When it is determined in step 12 that the weight of the workpiece measured by the workpiece supply unit 4 falls outside a predetermined value range previously stored in the storage part 8, the workpiece is discharged from the discharge part 42 in step 13 (ST13).

When it is determined in step 12 that the weight of the workpiece measured by the workpiece supply unit 4 falls within a predetermined value range previously stored in the storage part 8, the workpiece is supplied from the supply part 41 to the transfer unit 3 in step 14 (ST14).

Then, in step 15, the weight of the workpiece supplied to the transfer unit 3 is measured by the workpiece weight measuring unit 5 (ST15). Subsequently, in step 16, the controller 7 determines whether the weight of the workpiece measured by the workpiece weight measuring unit 5 falls within a first value range previously stored in the storage part 8 (ST16).

When it is determined in step 16 that the weight of the workpiece measured by the workpiece weight measuring unit 5 falls within the first value range previously stored in the storage part 8, the workpiece is subjected to press molding under a first condition in step 17 (ST17).

When it is determined in step 16 that the weight of the workpiece measured by the workpiece weight measuring unit 5 falls outside the first value range previously stored in the storage part 8, the controller 7 determines in step 18 whether the weight of the workpiece measured by the workpiece weight measuring unit 5 falls within a second value range previously stored in the storage part 8 (ST18).

When it is determined in step 18 that the weight of the workpiece measured by the workpiece weight measuring unit 5 falls within the second value range previously stored in the storage part 8, the workpiece is subjected to press molding under a second condition in step 19 (ST19).

When it is determined in step 18 that the weight of the workpiece measured by the workpiece weight measuring unit 5 falls outside the second value range previously stored in the storage part 8, the workpiece is subjected to press molding under a third condition in step 20 (ST20).

The first, second and third conditions correspond respectively to different bottom dead center positions of the upper molding die 26 determined with respect to the weights of workpieces. That is, the press-molding system 1 according to the present embodiment controls stepwise the position of the bottom dead center of the upper molding die 26 according to the workpiece weight. That is, the drive amount of the drive part 24 is also controlled stepwise.

With the above configuration, the capacity of the storage part 8 can be reduced to increase a calculation speed, making it possible to improve productivity at low cost.

The press-molding system 1 according to the present embodiment includes the press-molding unit 2 having the main body 21, the lower molding die 23 installed at the lower portion of the main body 21, the drive part 24 installed to the main body 21 and the upper molding die 26 installed so as to be vertically movable with respect to the lower molding die 23 by the drive part 24, the workpiece weight measuring unit 5 that measures the weight of a workpiece, and the controller 7 that controls the drive part 24 according to the weight of a workpiece measured by the workpiece weight measuring unit 5. With this configuration, there can be provided a press-molding system having high accuracy and productivity.

Further, in the press-molding system 1 according to the present embodiment, the controller 7 controls the drive amount of the drive part according to the weight of a workpiece measured by the workpiece weight measuring unit 5. Thus, the system 1 can easily perform highly accurate press molding.

Further, the press-molding system 1 according to the present embodiment includes the storage part 8 that stores the reference bottom dead center of the upper molding die 26. The controller 7 has the correction parts 71 and 73 in which correction amounts corresponding to workpiece weights are previously set and the addition/subtraction part 72 that calculates the corrected bottom dead center by adding or subtracting the correction amount set in the correction part 71 or 73 to or from the reference bottom dead center of the upper molding die 26 stored in the storage part 8 in accordance with the weight of the workpiece measured by the workpiece weight measuring unit 5 and controls the drive part 24 based on the corrected bottom dead center output from the addition/subtraction part 72 to thereby set the position of the bottom dead center of the upper molding die 26. Thus, the system 1 can achieve higher accuracy molding.

Further, in the press-molding system 1 according to the present embodiment, the controller 7 sets stepwise the correction amount of the correction part 71 or 73 and the corrected bottom dead center calculated by the addition/subtraction part 72. Thus, the system 1 makes it possible to improve productivity at low cost.

Further, the press-molding system 1 according to the present embodiment includes the transfer unit 3 that conveys a workpiece to the workpiece weight measuring unit 5 and the press-molding unit 2 in order. The controller 7 allows the press-molding unit 2 to mold a workpiece only when the weight of a workpiece measured by the workpiece weight measuring unit 5 falls within a predetermined value range. Thus, the system 1 can further improve productivity.

Further, the press-molding system 1 according to the present embodiment includes the workpiece supply unit 4 having the supply part 41 that supplies a workpiece to the transfer unit 3 and the discharge part 42 that discharges a nonstandard workpiece, thus enabling further improvement in productivity.

Further, the press-molding system 1 according to the present embodiment includes the finishing unit 6 that finishes a workpiece molded in the press-molding unit 2 and discharged from the transfer unit 3, thus enabling higher accuracy molding.

A press-molding method according to the present embodiment includes a step of measuring the weight of a workpiece, a step of determining whether the weight of a workpiece measured falls within a previously stored predetermined value range and a step of performing press-molding according to the weight of a workpiece when the measured workpiece weight falls within a previously stored predetermined value range. Thus, there can be provided a press-molding system having high accuracy and productivity.

Further, in the press-molding method according to the present embodiment, the step of performing press-molding according to the weight of a workpiece controls, in accordance with the measured workpiece weight, the drive amount of the drive part 24 that moves the upper molding die 26 installed so as to be vertically movable with respect to the lower molding die 23. Thus, the method can easily achieve highly accurate press molding.

Further, in the press-molding method according to the present embodiment, the step of performing press-molding according to the weight of a workpiece previously sets the correction amounts corresponding to workpiece weights, calculates a corrected bottom dead center of the upper molding die by adding or subtracting the correction amount set according to the measured workpiece weight to or from a stored reference bottom dead center of the upper molding die, and controls the drive amount of the drive part 24 based on the corrected bottom dead center. Thus, the method can achieve higher accuracy molding.

Further, in the press-molding method according to the present embodiment, the correction amount corresponding to the workpiece weight and the corrected bottom dead center are set stepwise. Thus, the method can make it possible to improve productivity at low cost.

The present invention is not limited to the above-described embodiments. That is, while the description of the embodiments includes specific and detailed contents for exemplification, variations or modifications may be applied to these detailed contents.

REFERENCE SIGNS LIST

1: Press-molding system
2: Press-molding unit
21: Main body
22: Lower die plate
23: Lower molding die
24: Drive part
25: Upper die plate
26: Upper molding die
3: Transfer unit
31: Conveying member
32: Arm
4: Workpiece supply unit
41: Supply part
42: Discharge part
5: Workpiece weight measuring unit
6: Finishing unit
7: Controller
71: Correction table (correction part)
72: Addition/subtraction part
73: Correction calculation part (correction part)
8: Storage part

The invention claimed is:

1. A press-molding system comprising:

a press-molding unit having a main body, a lower molding die installed at a lower portion of the main body, a drive part installed to the main body, and an upper molding die installed so as to be vertically movable with respect to the lower molding die by the drive part;

a workpiece weight measurer that measures the weight of a workpiece;

a controller that controls the drive part according to the weight of a workpiece measured by the workpiece weight measurer; and a storage that stores a reference bottom dead center of the upper molding die, wherein the controller has a correction part in which correction amounts corresponding to workpiece weights are previously set, and a calculator that calculates a corrected bottom dead center by adding or subtracting the correction amount set in the correction part to or from the reference bottom dead center of the upper molding die stored in the storage in accordance with the weight of the workpiece measured by the workpiece weight measurer and controls the drive part based on a corrected bottom dead center output from the calculator to thereby set the position of a bottom dead center of the upper molding die.

2. The press-molding system according to claim 1, wherein the controller sets stepwise the correction amount of the correction part and the corrected bottom dead center calculated by the calculator.

3. The press-molding system according to claim 1, comprising a conveyer that conveys the workpiece to the workpiece weight measurer and the press-molding unit in order, wherein the controller allows the press-molding unit to mold the workpiece only when the weight of the workpiece measured by the workpiece weight measurer falls within a predetermined value range.

4. The press-molding system according to claim 3, comprising the workpiece supply device having a supplier that supplies a workpiece to the conveyor and a discharger that discharges a nonstandard workpiece.

5. The press-molding system according to claim 4, further comprising a finisher that finishes a workpiece molded in the press-molding unit and discharged from the conveyor.

6. A press-molding method comprising the steps of:

measuring a weight of a workpiece;

determining whether the weight of the workpiece measured falls within a previously stored predetermined value range; and performing press-molding according to the weight of the workpiece when the measured workpiece weight falls within the previously stored predetermined value range, wherein the step of performing press-molding according to the weight of the workpiece controls, in accordance with the measured workpiece weight, a drive amount of a drive part that moves an upper molding die installed so as to be vertically movable with respect to a lower molding die, and wherein the step of performing press-molding according to the weight of the workpiece previously sets correction amounts corresponding to workpiece weights, calculates a corrected bottom dead center of the upper molding die by adding or subtracting the correction amount set according to the measured workpiece weight to or from a stored reference bottom dead center of the upper molding die, and controls the drive amount of the drive part based on the corrected bottom dead center.

7. The press-molding method according to claim 6, wherein the correction amounts corresponding to the workpiece weight and the corrected bottom dead center are set stepwise.

* * * * *